United States Patent [19]

Sathre, Jr. et al.

[11] Patent Number: 4,705,930

[45] Date of Patent: Nov. 10, 1987

[54] HEATING CONTROL APPARATUS

[75] Inventors: Curtis J. Sathre, Jr.; Mark R. Thornton, both of Fresno, Calif.

[73] Assignee: Duncan Enterprises, Fresno, Calif.

[21] Appl. No.: 890,927

[22] Filed: Jul. 31, 1986

[51] Int. Cl.[4] ..... H05B 1/02

[52] U.S. Cl. ..... 219/492; 219/493; 219/508; 219/494; 219/490; 236/46 R; 432/51

[58] Field of Search ..... 219/492, 493, 494, 413, 219/412, 501, 497, 507, 508, 509, 491; 236/15 BB, 46 R, 46 F; 432/51

[56] References Cited

U.S. PATENT DOCUMENTS

| | | | |
|---|---|---|---|
| 3,855,452 | 12/1974 | Flasza et al. | 219/492 |
| 4,300,037 | 11/1981 | Padden | 219/497 |
| 4,334,146 | 6/1982 | Sturm | 219/492 |
| 4,367,399 | 1/1983 | Anthony et al. | 219/497 |
| 4,370,546 | 1/1983 | Warner | 219/497 |
| 4,547,657 | 10/1985 | Sticher, Jr. et al. | 219/492 |

*Primary Examiner*—M. H. Paschall

*Attorney, Agent, or Firm*—Worrel & Worrel

[57] ABSTRACT

A heating control apparatus for exciting the heating element of a kiln or the like. The heating control apparatus includes an interval timer that produces a pulse of electricity having a predetermined duration of time, a fixed timer adapted to open and close an electrical path, and a power relay connected to the heating element and which is adapted to excite the heating element for selected periods of time in response to the operation of the fixed and interval timers.

10 Claims, 2 Drawing Figures

HEATING CONTROL APPARATUS

BACKGROUND OF THE INVENTION

1. Field of the Invention

The present invention relates to a heating control apparatus adaptable to a wide variety of uses but having particular utility when incorporated in the controls of a kiln or the like, and more particularly to a heating control apparatus that is inexpensive to manufacture and which has improved performance relative to prior art devices, particularly with respect to providing for the easy one-step operation of the kiln, the apparatus providing enhanced operational characteristics for the kiln under a variety of time, temperature and load conditions.

2. Description of the Prior Art

One of the hobbies most enjoyed by arts and crafts enthusiasts is that of ceramic crafts. With the advent of improved instruction techniques and the development of relatively inexpensive materials and equipment, this once quite exclusive hobby is now enjoyed by large numbers of individuals of all levels of artistic and creative ability.

However, whether in the hobby or in the industrial area, artisans practicing in the ceramic arts agree that one of the most important considerations in the firing of a ceramic piece is to control the low fire heating stage to prevent the piece from becoming damaged. Those skilled in the ceramic arts recognize, in firing a piece of ceramic material, that a hazard of damage or explosion exists if heat energy is imparted to the piece in too rapid a fashion. As heat energy is applied to an unprocessed piece of ceramic material, water in the form of steam and other gases are driven off from the piece. It has long been known if excessive heat energy is applied too early during firing, gases and other vapor which would have escaped from the piece are caused to be trapped internally of the piece. This entrapment of the gas is caused by the expansion of the external surface of the piece in such a manner that substantially all the surface pores, which would have permitted the escape of the gases, are closed off. If this situation is allowed to continue, the heat energy which continues to be imparted to the piece causes the expansion of the gas and other vapors internally of the piece until such time as the expanding gas destroys the piece by fracturing it, or, in aggravated situations, causing it to explode. In this latter situation, there is an attendant risk of injury to persons in the area.

Manufacturers of kilns and artisans have approached the problem of controlling the heat imparted to a ceramic piece during firing by directing their attention to improving the controls which deactivate the kiln after selected periods of time and which control the rate of heat input to the kiln. The controls that are adapted to influence the rate of heat input in the kiln are of two general types, manual and electronic. Manual controls have significant shortcomings because they require repeated trips to the kiln. Electronic controls are expensive, sensitive to heat energy produced by the kiln and are not generally responsive to varying firing loads.

Although there have been some significant advances in producing kilns for home and industrial use which give the individual craftsman improved control with respect to the amount of heat energy imparted to a ceramic piece during all stages of kiln operation, the improvements have only been marginally satisfactory. As a consequence, artisans of all levels of artistic ability have continued to seek a kiln having one-step controls which permit them to preselect the correct low fire and high fire load conditions for the ceramic piece which will be fired, whereby the kiln will automatically, after a predetermined period of time, switch from the low fire stage to the high fire stage to permit the efficient processing of the ceramic piece.

Therefore, it has long been known that it would be desirable to have an improved heating control apparatus for kilns or the like which is adapted for both home and industrial use, which has improved control characteristics and which otherwise performs in a highly advantageous manner under variable load conditions.

SUMMARY OF THE INVENTION

It is, therefore, an object of the present invention to provide an improved heating control apparatus for kilns or the like.

Another object is to provide such a heating control apparatus which is operable automatically to control the heat energy applied to a workpiece so as to prevent damage to the workpiece therefrom.

Another object is to provide such an a heating control apparatus which is particularly well suited to use on kilns in preventing the fracturing or explosion of ceramic workpieces as the result of gas build up in the workpieces during the application of heat energy thereto.

Another object is to provide such a heating control apparatus for kilns which is particularly well suited for the precise metering of energy to the kiln and otherwise effectively controlling the kiln under a wide variety of different load conditions.

Another object is to provide such a heating control apparatus for kilns, which gives an artisan improved control over the amount of heat energy imparted to a ceramic piece during low fire and high fire stages of processing.

Another object is to provide such a heating control apparatus for kilns which is particularly well suited to switching the kiln automatically from the low fire stage to the high fire stage after a predetermined period of time.

Another object is to provide such a heating control apparatus for kilns which improves the performance characteristics of kilns of all types employed by both home and industrial craftsmen alike.

Another object is to provide such a heating control apparatus which acquires its superior performance characteristics by having structural features which are relatively inexpensive and which have application to kilns of all types.

Further objects and advantages are to provide an improved heating control apparatus for kilns for the purposes intended which is dependable, durable, and fully effective in accomplishing its intended purposes.

These and other objects and advantages are achieved in a heating control apparatus adapted for metering a supply of electrical energy to the heating elements of a kiln wherein a power relay integral with the kiln couples a source of electricity to the heating element; an interval timer develops and transmits an electrical pulse to the power relay; and a fixed timer is adapted to open and close an electrical path whereby the power relay excites the heating elements for selected predetermined amounts of time during a low fire stage of operation and thereafter excites the heating elements substantially continuously during a high fire stage of operation.

DESCRIPTION OF THE PREFERRED EMBODIMENT

Figure 1:
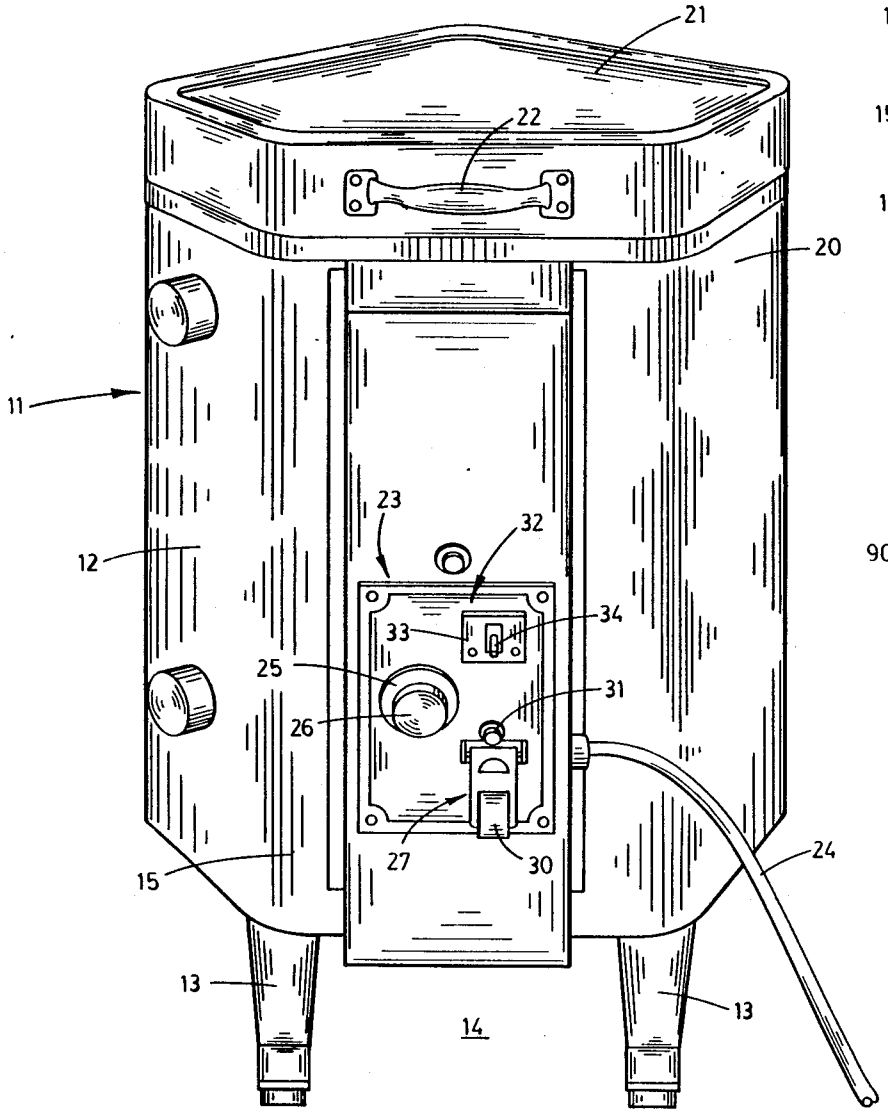
FIG. 1 is an orthographic side elevation of a kiln employing the heating control apparatus of the present invention.

Referring more particularly to the drawing, the heating control apparatus of the present invention is generally indicated by the numeral 10 in FIG. 1. The apparatus 10 is adaptable to a wide variety of uses, but has particular utility in the operation of a kiln or the like. As will hereinafter be described in greater detail, in the described embodiment the apparatus 10 is installed in and constitutes an operable portion of the controls of a kiln 11 having a conventional single heating zone configuration. For illustrative convenience, the kiln as shown and described herein is of the single heating zone configuration, as will be described, and can be employed by both home and industrial craftsmen. However, it should be understood that the apparatus 10 can be employed in a variety of different embodiments on a variety of different heating apparatuses, including kilns of all sizes and types and whether of the single or multi-heating zone configuration.

As will hereinafter be described in greater detail, the apparatus 10 is adapted to be installed at the time of manufacture or by retrofitting in a kiln such as that illustrated at 11 in FIG. 1. Except with respect to the apparatus of the present invention, it will be understood that the kiln is of a conventional type. The kiln has an insulated main body 12 which has legs 13 operable to support the main body in an upright attitude on a suitable supporting surface 14. The insulated main body has an internal chamber, not shown, which is adapted to receive a ceramic piece for curing during the various firing stages of operation of the kiln. The main body has a first or base end 15 and an opposite second or loading end 20. A closure member 21, having a handle 22, is mounted for pivotal movement on the main body 12 by a suitable hinge, not shown, which permits the operator of the kiln to gain access to the internal chamber of the loading end of the main body.

A control panel generally indicated by the numeral 23 in FIG. 1 is mounted on the main body 12 adjacent to the first end 15 thereof. The control panel is provided with a constant supply of electricity by a power cable 24 adapted for connection to a conventional 120 Volt, alternating current power outlet, not shown. However, it should be understood that the kiln 11 and the apparatus 10 of the subject invention can be adapted to receive three-phase direct electrical current. The control panel has a safety timer 25 which is operated by a control knob or member 26. The safety timer permits the operator to select a predetermined time, normally in hours, after which the kiln will automatically turn off. It should be understood that this safety timer is unrelated to the apparatus of the present invention and is only incorporated into the kiln controls for the purpose of having a backup safety system for terminating kiln firing operations.

Figure 2:
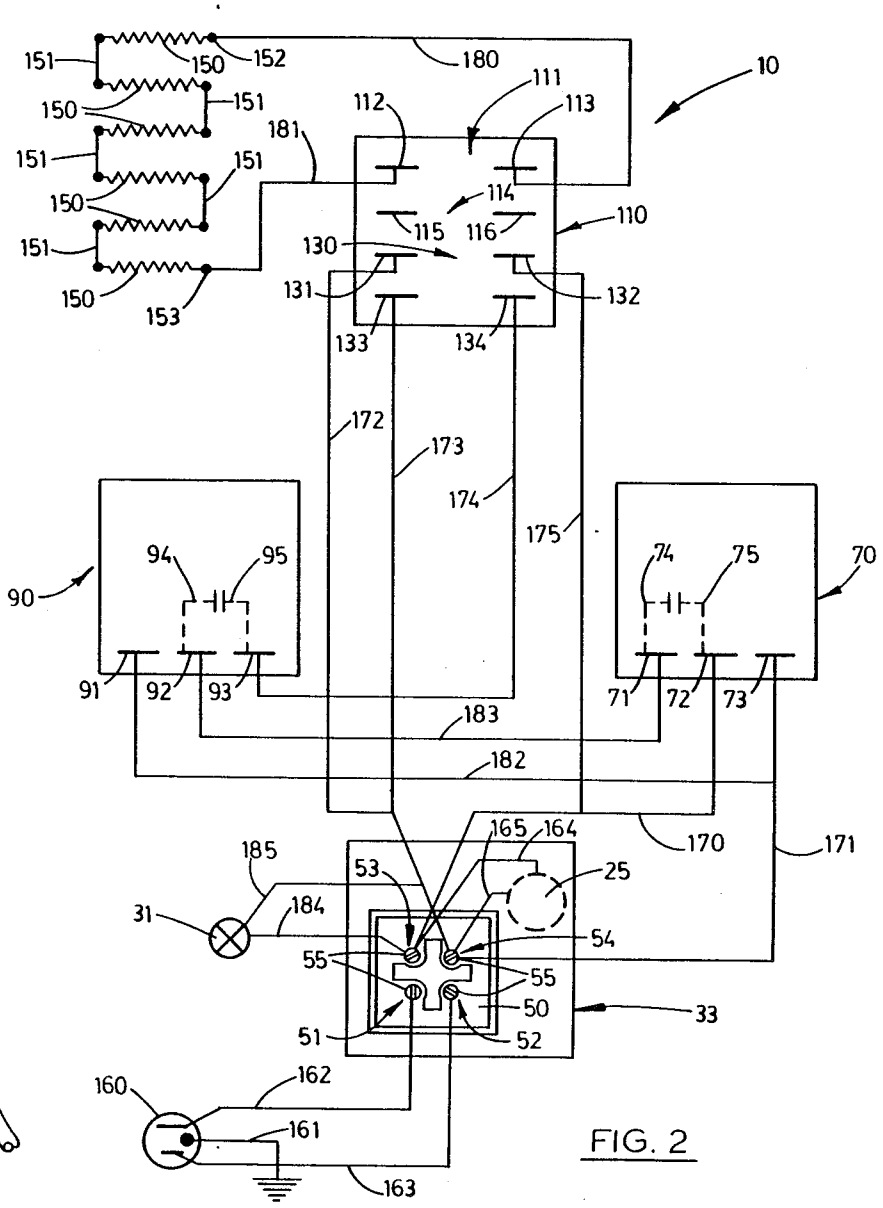
FIG. 2 is a schematic diagram of the heating control apparatus of the present invention.

The kiln 11 has a power switch assembly 27 which is operable to permit electrical energy to be supplied to the control panel 23 from the power cable 24. The power switch assembly has a toggle switch member, not visible in FIG. 1, which is overlaid by a pivotally attached switch cover 30 which protects the toggle switch member positioned thereunder. When the toggle switch is placed in an energized position, a control light 31, located immediately adjacent to the power switch assembly, lights up to indicate to the operator that power is being received by the control panel. The kiln has an energy sensing termination device 32 which is integral with the control panel and which is adapted to turn the kiln off after a predetermined period of time. The termination device 32, which is schematically illustrated in FIG. 2, is of a conventional design and has a pyrometric cone termination switch 33, which has heretofore been commonly employed in the ceramic art field. Such termination switches have generally been employed to insure that the kiln will produce a certain quality of ceramic product under a particular set of predetermined time, temperature and load conditions. The termination switch, which is not shown in any detail, but which is well understood in the art, mounts a pyrometric cone of ceramic material which extends internally of the kiln and which softens and bends under its own weight after certain heat treatment. It should be understood that when a kiln employing such a termination switch has imparted a predetermined amount of heat energy to a ceramic piece being fired, the pyrometric cone, receiving this same heat energy bends. The bending cone causes a switch member 34, mounted internally of the cone, to be urged downwardly to a deenergized position whereby electrical energy flow to the kiln is terminated. The switch member 34 is mounted for pivotal movement on the termination device about a substantially horizontal axis. The end of the switch member 34 opposite the portion thereof extending internally of the cone is visible in FIG. 1.

As best understood by reference to FIG. 2, the apparatus 10 is adapted to meter electrical energy to the kiln 11. The apparatus includes certain electrical components which are individually known, but, to the applicants' knowledge, not in the combination of the apparatus of the present invention nor for the purposes hereof. The apparatus 10 has a terminal block 50 operable to couple a supply of electrical energy from an external source with the apparatus. The terminal block, which is itself of conventional design, has electrical terminals 51, 52, 53 and 54 which are screw-threadably adapted to receive screws 55. The terminals 51 and 52 are electrically coupled through the terminal block with the electric terminals 53 and 54, which are closely adjacent thereto. The terminal block 50 is electrically interconnected with the termination switch 33 and the safety timer 25.

The apparatus 10 has an electro-responsive interval timer 70 shown schematically in FIG. 2. The interval timer 70, which is of conventional design, has electrical terminals 71, 72 and 73, respectively. In addition, the interval timer has electrical contacts 74 and 75, which are individually operably connected to electrical terminals 71 and 72, respectively, and are caused to be moved into contact, one with the other, for selected periods of time for the purpose of developing and transmitting an electrical pulse having a predetermined duration of time. The duration of the electrical pulse is calculated to cause the kiln to emit a quantity of heat energy which corresponds with a predetermined low fire temperature condition required for a ceramic piece which is being fired. In the preferred embodiment this period is preset by the manufacturer. However, an interval timer which is adjustable by the operator can also be employed.

The apparatus 10 has an electro-responsive fixed timer 90 shown in FIG. 2. The fixed timer, as used herein, is of conventional design and is in the preferred embodiment capable of being adjusted by the operator to select the specific period of time desired. The fixed timer 90 has electrical terminals 91, 92 and 93, respectively, and electrical contacts 94 and 95. The electrical contacts 94 and 95 are individually operably connected to electrical terminals 92 and 93 respectively and are selectively movable into contact by the fixed timer, and are adapted to be held in such contact, one with the other, for predetermined periods of time. It should be understood that the fixed timer is of conventional configuration and can either be in the form of a solid state electrical timer, or a mechanical timer, depending upon the desires of the kiln manufacturer. The fixed timer causes the electrical contacts to be held together in an electrically closed configuration, for a predetermined period of time. This predetermined period of time is calculated to correspond with a predetermined low fire time condition required for the ceramic piece which is being fired.

The apparatus 10 has a conventional power relay 110 which, as incorporated in the apparatus, selectively delivers the supply of electrical energy to the kiln 11 as will hereinafter be described. The power relay has a normally closed switch 111 which has electrical terminals 112 and 113. The switch 111 is closed in a first mode or condition constituting its normal mode or condition and is open in a second mode or condition. Being a conventional power relay, it also has a normally open switch 114 which has electrical terminals 115 and 116. However, the switch 114, as can be seen in FIG. 2, is not wired into the apparatus and thus serves no function in the apparatus 10. The power relay further has a coil contact 130 which has electric terminals 131 and 132 and input terminals 133 and 134. The power relay, it should be understood, is if a conventional type.

The power relay 110 selectively delivers electrical energy to excite a multiplicity of conventional heating elements, indicated by the numeral 150. The heating elements are interconnected by bus bars 151, as shown in FIG. 2. It should be appreciated that a bus bar functions as an electrical conductor which is operable to serve as a common connection between load circuits, in this case the heating elements, in one phase of an alternating current system. The heating elements are adapted to receive electrical energy through electric terminals 152 and 153, respectively.

As best understood by reference to FIG. 2, the power cable 24 mounts a plug 160 for coupling the apparatus 10 with a supply of electricity, such as a conventional 120 Volt, alternating current electrical outlet, not shown. The apparatus 10 includes an electrical circuit interconnecting the various operable components of the apparatus as shown in FIG. 2 and hereinafter described. It is the interconnection of the electrical components by the electrical circuit which achieves the advances over the prior art of the apparatus of the present invention. Thus the electrical circuit of FIG. 2 includes an electrical conductor 161 connected to the plug in such a manner as to provide an electrical ground for the apparatus. A pair of electrical conductors 162 and 163 extend through the power cable 24 and individually operably connect the plug with electric terminals 51 and 52, respectively, as shown in FIG. 2. Electrical conductors 164 and 165 individually extend from electric terminals 53 and 54 to the safety timer 25 operably to couple the safety timer with the terminal block 50. Electrical energy passing from the terminal block to the interval timer 70 travels along electrical conductor 170, which extends from electrical terminal 53 of the terminal block to electrical terminal 72 of the interval timer. Electrical conductor 171 extends from electrical terminal 54 of the terminal block to electrical terminal 73 of the interval timer. Electrical energy imparted to the power relay 110 is received via electrical conductor 172, which extends from electrical terminal 54 of the terminal block to electrical terminal 131 of the power relay. Electrical conductor 173 extends from electrical conductor 172 to electrical terminal 133 of the power relay. Electrical conductor 174 extends from electrical terminal 93 of the fixed timer to electrical terminal 134 of the power relay. Electrical conductor 175 extends from electrical conductor 170 to electrical terminal 132 of the power relay.

The heating elements 150 are operably connected to the power relay 110 by an electrical conductor 180 which extends from electrical terminal 113 of the power relay to electrical terminal 152 of the uppermost heating element 150 as viewed in FIG. 2. Electrical conductor 181 extends from electrical terminal 112 of the power relay to electrical terminal 153 of the lowermost heating element 150 as viewed in FIG. 2. The several heating elements 150 are themselves interconnected by bus bars 151 as heretofore described. Electrical energy is delivered to the fixed timer 90 by electrical conductor 182 which interconnects electrical conductor 171 and the electrical terminal 91 of the fixed timer. Electrical conductor 183 interconnects electrical terminal 71 of the interval timer 70 and electrical terminal 92 of the fixed timer 90. Electrical energy is supplied to the control light 31 by electrical conductor 184 which extends from electrical terminal 53 of the terminal block 50 to the control light. Electrical conductor 185 extends from electrical conductor 172 to the control light. An electrical path formed by electrical conductors 183 and 174 permits the electrical pulse produced by the interval timer 70 to reach the power relay 110 through the fixed timer.

OPERATION

The operation of the described embodiment of the subject invention is believed to be clearly apparent and is briefly summarized at this point.

The operation of the apparatus 10 is described herein as it would occur if such an apparatus were installed in a kiln 11 which has a conventional single zone configuration. However, as previously noted the inventive concept hereof can be employed with equal success to control the operation of a kiln having a multi-zone configuration. It should be understood that multi-zone kilns are essentially the same in overall construction as that of a single zone kiln with the exception that portions of the kiln are heated by separately controllable heating elements.

The kiln 11 has a low fire stage of operation which prevents a ceramic piece, not shown, from cracking or, otherwise becoming damaged, as a consequence of the heat induced production of water vapor and other gases within the ceramic piece. Upon activation of the kiln, the interval timer 70 is adapted to produce an electrical pulse. The electrical pulse is created when the interval timer moves the electrical contacts 74 and 75 into contact with each other for the predetermined periods of time. The duration of this time period, wherein these electrical contacts are apposed together is calculated, substantially, to correspond with a predetermined low fire temperature condition required for the ceramic piece to be properly fired.

An electrical path, formed by electrical conductors 183 and 174, respectively, operatively couples, and permits the transmission of the electrical pulse formed by the interval timer 70 to the power relay 110 through the fixed timer 90. The fixed timer is operably interconnected to the electrical path and is adapted to open and close the electrical path after a preselected time period. Upon activation of the kiln 11, the fixed timer maintains the electrical path in an electrically closed condition for a period of time that substantially corresponds with the predetermined low fire time condition required for the ceramic piece to be properly fired. It should be understood that during the low fire stage of operation, the electrical path which is closed, permits the power relay to receive the electrical pulse. The normally closed switch 111 of the power relay is responsive, when the power relay receives the electrical pulse, to be urged to an electrically open position and thus prevent the power relay from exciting the heating elements 150. Correspondingly, when the electrical pulse terminates, the normally closed switch returns to its normally closed position whereby the power relay is permitted to excite the heating elements. The duration of the electrical pulse causes the heating elements of the kiln 11 to emit a temperature which substantially corresponds with a predetermined low fire temperature condition required for the ceramic piece to be properly fired. The interval timer 70 can be adapted to cycle continuously in this fashion throughout all firing stages of the kiln.

To initiate the high fire stage of operation, the fixed timer 90 opens the electrical path formed by electrical conductors 183 and 174 by moving contacts 94 and 95 apart. After a predetermined period of time the power relay 110 thereafter becomes unresponsive to the electrical pulse developed by the interval timer, since the electrical path is broken between electrical conductors 183 and 174 through the fixed timer, and thus thereafter constantly delivers electrical energy from the source of electricity to the heating elements 150. This constant delivery of electrical energy to the heating elements causes the heating elements to emit a temperature which substantially corresponds with a predetermined high fire temperature required for the ceramic piece to be fired. It should be appreciated that the interval timer can continue to make and break contact employing electrical contacts 74 and 75. However, the electrical pulse which is developed has no effect on the power relay 110 because there is no conductive path which permits it to reach the power relay since contacts 94 and 95 of the fixed timer 90 are apart.

The high fire stage of operation continues until the termination switch 33 mounting the pyrometric cone previously described terminates the supply of electricity reaching the power relay 110 because of having detected the condition of the ceramic piece in the kiln as also already described. A safety timer 25 provides a safety back-up system to terminate the flow of electricity to the kiln at a predetermined time, after operation begins.

The apparatus 10 of the present invention permits an operator of a kiln 11 to correctly, accurately and automatically fire a ceramic piece for predetermined periods of time by selectively adjusting the fixed and interval timers to cause the kiln to produce a finished ceramic product, without the corresponding need of the operator to return to the kiln on numerous occasions operably to adjust the kiln from a low fire to a high fire stage of operation.

Therefore, the heating control apparatus of the present invention for kilns and the like is adapted for both home and industrial use with control characteristics substantially improved over prior art devices available at low cost and otherwise performing in a highly advantageous manner.

Although the invention has been herein shown and described in what is conceived to be the most practical and preferred embodiment, it is recognized that departures may be made therefrom within the scope of the invention, which is not to be limited to the illustrative details disclosed.

Having thus described our invention, what we claim as new and desire to secure by Letters Patent is:

1. A heating control apparatus for a heating element mounted internally of a kiln, the apparatus comprising a power relay borne by the kiln, the power relay mounting a normally closed switch operable to supply electrical energy to the heating element in a first operating condition and to terminate the supply of electrical energy to the heating element in a second operating condition in response to receiving an electrical pulse; an interval timer borne by the kiln and operatively connected to said normally closed switch for periodically supplying said electrical pulse to the normally closed switch; and a fixed timer interposed between the interval timer and the normally closed switch operable to maintain communication between the interval timer and the normally closed switch for one period of operation and to prevent communication between the interval timer and the normally closed switch during another period of operation whereby the heating element is intermittently supplied with electrical energy during one phase of operation and is continuously supplied with electrical energy during another phase of operation.

2. A heating control apparatus for controlling the supply of electricity to a heating element of a kiln, the apparatus comprising a power relay operably connected between the supply of electricity and the heating element and operable normally to deliver electricity to said heating element in first mode and to terminate delivery of electricity to said heating element in a second mode;

a pulse developing means adapted to provide a pulse of electricity having a predetermined duration of time, the pulse of electricity causing the power relay to assume the second mode;

an electrical path coupling the pulse developing means and the supply of electricity with the power relay, said electrical path receiving the electrical pulse and transmitting said electrical pulse to the power relay to cause the power relay to assume said second mode; and means for opening and closing the electrical path whereby when the electrical path is in an opened condition the power relay is no longer responsive to the operation of the pulse developing means thereby retaining the power relay in said first mode to deliver electrical energy continually to the heating element, the heating element thereby being operable to produce high fire and low fire temperatures when operating in the first or second modes respectively.

3. The apparatus of claim 2 wherein the power relay includes a normally closed switch responsive to a pulse of electricity received from the pulse developing means to open said switch in said second mode and terminate the supply of electricity to the heating element and, upon termination of the pulse, to close said switch in said first mode to permit the power relay to supply electricity to the heating element.

4. The apparatus of claim 3 wherein said pulse developing means includes an interval timer and said means for opening and closing the electrical path includes a fixed timer.

5. The apparatus of claim 4 wherein the fixed timer maintains the electrical path closed for a predetermined period of time.

6. A heating control apparatus interconnecting a source of electricity and a multiplicity of heating elements of a kiln, the apparatus comprising a power relay integral with the kiln for exciting the heating elements thereof, the heating elements producing a preselected high fire temperature when in a normal first mode of operation, said power relay not exciting the heating elements in a second mode of operation to produce a preselected low fire temperature and the power relay mounting a normally closed switch which is operable, when excited, to cause the power relay to assume the second mode of operation;

a first electrical circuit operably interconnecting the power relay, heating elements and the source of electricity;

an interval timer adapted periodically to develop and transmit an electrical pulse having a predetermined duration, the electrical pulse when received by the power relay causing the normally closed switch to become excited;

a second electrical circuit operably interconnecting the normally closed switch, interval timer, and the source of electricity, said second electrical circuit receiving said electrical pulse developed by the interval timer; and a fixed timer operably connected in the second electrical circuit between the normally closed switch and the interval timer, the fixed timer adapted to retain said second electrical circuit in an electrically closed condition for a predetermined period of time to permit the interval timer to transmit said electrical pulse periodically to cause the normally closed switch to become excited, the normally closed switch causing the power relay to assume said second mode of operation and after said predetermined period of time to open said second electrical circuit to retain the normally closed switch isolated from said electrical pulses transmitted by the interval timer, the normally closed switch permitting the power relay to assume the normal first mode of operation thereby continuously exciting the heating elements.

7. The apparatus of claim 6 wherein the kiln has a low fire and high fire stage of operation, said electrical pulse, when received by the normally closed switch causing the kiln to operate in the low fire stage and when the normally closed switch is isolated from the electrical pulse causing the kiln to operate in the high fire stage.

8. The apparatus of claim 7 wherein the interval timer is adjustable to select the length of the electrical pulse to control temperature condition in said low fire stage for the ceramic piece to be fired in the kiln.

9. The apparatus of claim 8 wherein the predetermined period of time the fixed timer maintains the second electrical circuit closed substantially corresponds to the length of time for the low fire stage required for the ceramic piece to be fired in the kiln.

10. The apparatus of claim 9 wherein the heating elements of the kiln during the high fire stage emit a temperature which substantially corresponds with a predetermined high fire temperature condition required for the ceramic piece to be fired in the kiln.

* * * * *